US012534248B2

(12) United States Patent
Matsui

(10) Patent No.: US 12,534,248 B2
(45) Date of Patent: Jan. 27, 2026

(54) BOX FOLDING SYSTEM

(71) Applicant: FANUC CORPORATION, Yamanashi (JP)

(72) Inventor: Hiroki Matsui, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 16 days.

(21) Appl. No.: 18/725,023

(22) PCT Filed: Mar. 16, 2022

(86) PCT No.: PCT/JP2022/012071
§ 371 (c)(1),
(2) Date: Jun. 27, 2024

(87) PCT Pub. No.: WO2023/175804
PCT Pub. Date: Sep. 21, 2023

(65) Prior Publication Data

US 2025/0100731 A1 Mar. 27, 2025

(51) Int. Cl.
*B65B 43/28* (2006.01)
*B65B 57/16* (2006.01)
*B65B 69/00* (2006.01)

(52) U.S. Cl.
CPC ..... *B65B 43/285* (2013.01); *B65B 57/16* (2013.01); *B65B 69/0025* (2013.01)

(58) Field of Classification Search
CPC ... B65B 43/285; B65B 57/16; B65B 69/0025; B65B 43/39
See application file for complete search history.

(56) References Cited

U.S. PATENT DOCUMENTS

2014/0179501 A1* 6/2014 Akama ..... B31B 50/262 493/162
2021/0078742 A1* 3/2021 Hashimoto ..... B25J 9/06

FOREIGN PATENT DOCUMENTS

JP H05-254525 A 10/1993
JP 2000-153816 A 6/2000
JP 2018-043786 A 3/2018
JP 2018039181 A * 3/2018

OTHER PUBLICATIONS

Machine translation of JP-2018039181-A (Year: 2018).*
International Search Report issued in PCT/JP2022/012071; mailed May 17, 2022.

* cited by examiner

*Primary Examiner* — Himchan Song
(74) *Attorney, Agent, or Firm* — Studebaker Brackett PLLC

(57) ABSTRACT

An empty box folding system according to an aspect of the present disclosure that allows easy change in the size of the box folds a box formed from a box sheet having a plurality of interconnected panels, the system comprising: a robot that has a working head that suctions the box sheet and moves the box; and a folding aid member that changes a relative angle of the panels by abutting against the box moved by the robot.

6 Claims, 4 Drawing Sheets

BOX FOLDING SYSTEM

TECHNICAL FIELD

The present invention relates to a box folding system.

BACKGROUND ART

Various commodities are transported by being packaged in boxes. As such boxes for transportation, cardboard boxes, each of which is formed of one cardboard sheet and has a body portion in a quadrilateral tube shape, a lid extending from the body portion to seal the body portion, and a plurality of flaps forming a bottom are widely used. In general, a box such as a cardboard box is folded flat so as to occupy as little space as possible, after a commodity is taken out.

In the case of requiring work for sequentially taking out commodities from many boxes and providing the commodities for manufacturing facilities or the like, it can be considered to automatically take out the commodities from the boxes and fold the boxes. There is proposed an apparatus that opens the flaps of a cardboard box with a swing piece having a vacuum suction cup at its distal end, takes out a commodity while holding the flaps in the open state with a guide, and finally folds the cardboard box with the swing piece that suctions the body portion (see, for example, Patent Document 1).

CITATION LIST

Patent Document

Patent Document 1: Japanese Unexamined Patent Application, Publication No. H5-254525

DISCLOSURE OF THE INVENTION

Problems to be Solved by the Invention

In the case of opening flaps and folding a box with a swing piece that suctions and swings a cardboard sheet, it is necessary to arrange a swing piece with an appropriate length at an appropriate position according to each of the operations. Therefore, in the case of changing the size of the box, it is necessary to perform work for adjusting the length and arrangement of the swing piece. Therefore, a system making it possible to easily change a box size is desired.

Means for Solving the Problems

An box folding system according to one aspect of the present disclosure is a box folding system for folding a box formed of a box sheet including a plurality of interconnected panels, the box folding system including: a robot including a work head that suctions the box sheet, the robot moving the box; and a folding-aid member that changes relative angles of the panels by coming into contact with the box moved by the robot.

Effects of the Invention

According to the present disclosure, it is possible to easily change a box size.

PREFERRED MODE FOR CARRYING OUT THE INVENTION

Figure 1:
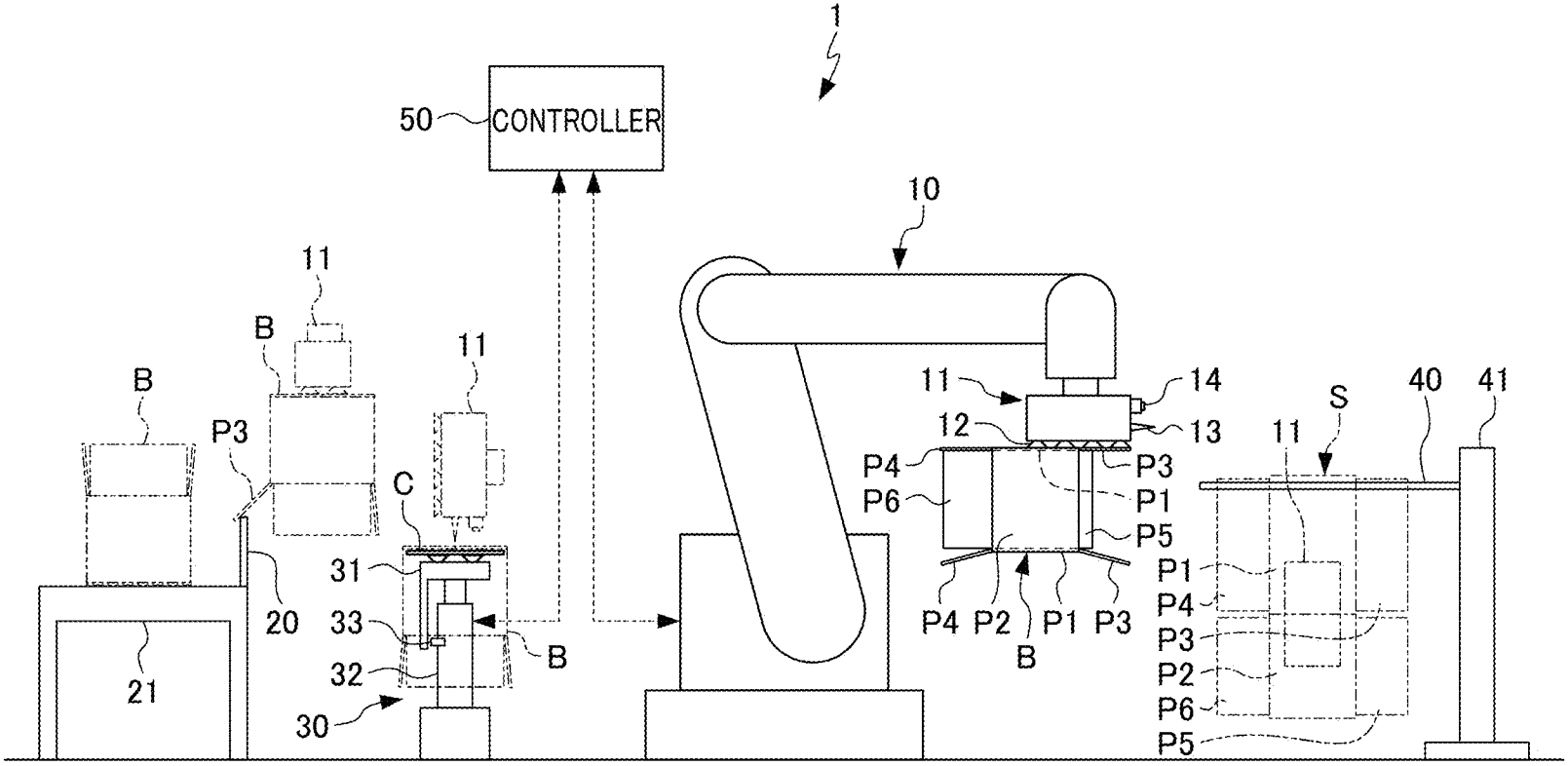
FIG. 1 is a schematic diagram showing a configuration of a box folding system according to a first embodiment of the present disclosure.

An embodiment of the present disclosure will be described below with reference to drawings. FIG. 1 is a schematic diagram showing a configuration of a box folding system 1 according to a first embodiment of the present disclosure;

The box folding system 1 is a system for folding a box B flat, the box B being formed of a box sheet S having a plurality of interconnected panels. As the box sheet S, for example, a slotted-type cardboard box stipulated as the code number 02 of JIS-Z1507, typically, a 0201-type (formerly A-1 type) cardboard box is assumed.

The 0201-type box sheet S has a plurality of panels that include a pair of length face panels P1 and a pair of width face panels P2, which are laterally and alternately connected to form a quadrilateral-tube-shaped portion, two pairs of outer flaps (upper outer flaps P3 and lower outer flaps P4) extending from upper edges and lower edges of the pair of length face panels P1, respectively, and two pairs of inner flaps (upper inner flaps P5 and lower inner flaps P6) extending from upper edges and lower edges of the pair of width face panels P2, respectively. The 0201-type box sheet S is assembled into a box B that is sealed by combining the upper flaps P3 and P5 to form a lid for sealing the lower end of the quadrilateral-tube-shaped portion and combining the lower flaps P4 and P6 to form a bottom for sealing the upper end of the quadrilateral-tube-shaped portion. As for the terms "lateral", "upper", "lower", and the like, directions at the time of using a common box B are used merely for convenience, and the terms do not limit the directions of the box B in the box folding system 1.

The box folding system 1 is provided with a robot 10 that moves the box B, an opening-aid member 20 that opens any of the outer flaps P3 and P4 and the inner flaps P5 and P6 by the robot 10 coming into contact with the box B, a pad taking-out apparatus 30 that takes out a buffer pad C arranged in the box B in cooperation with the robot 10, a folding-aid member 40 that changes relative angles of the panels (especially relative angles between the width face panels P2 and inner flaps P5 and P6) by the robot 10 coming into contact with the box B that is moving, and a controller 50 that controls the robot 10 and the pad taking-out apparatus 30.

The robot 10 has a work head 11 that suctions the box sheet S, at its end and is configured to be able to move the box sheet S (including the box B in an assembled state) by changing the position and direction of the work head 11. Though, typically, a vertical articulated robot can be used as the robot 10, a robot in a different type may be used.

The work head 11 can be configured to suction the box sheet S with a plurality of suction pads 12. The work head 11 is designed to have a sufficient size and vacuum suction force so as to be able to hold two adjoining panels of the box sheet S (a length face panel P1 and a lower outer flap P4, or a length face panel P1 and a width face panel P2) substantially flat at the same time.

Further, the work head 11 may have a cutter 13 that cuts tapes that hold the outer flaps P3 and P4 in a sealed state and a sensor 14 that confirms positions to cut the tapes (the outer edges of the outer flaps P3 and P4) so that the flaps P3 to P6 can be opened.

The opening-aid member 20 has a width smaller than the lateral width of each of the length face panels P1 and the width face panels P2 and is formed such that it can be inserted into the box B held by the robot 10. Further, it is favorable that the opening-aid member 20 has a length larger than the extension length of the laps P3 to P6. The opening-aid member 20 is disposed to protrude upward. In the present embodiment, the opening-aid member 20 is firmly fixed to an end part of a table 21 onto which the box B is supplied. In the present embodiment, the box B the lid (the upper flaps P3 and P5) of which is opened and from which a commodity inside has been taken out is supplied onto the table 21.

The pad taking-out apparatus 30 has a suction unit 31 that is inserted into the box B and suctions the buffer pad C, a support unit 32 that supports the suction unit 31 at its distal end, and a pad confirmation unit 33 that judges presence or absence of the buffer pad C. In the present embodiment, the support unit 32 supports the suction unit 31 such that the suction unit 31 is movable in a direction of insertion into the box B (the vertical direction), and the pad confirmation unit 33 has a sensor that detects movement of the suction unit 31 relative to the support unit 32. Specifically, the suction unit 31 has a weight making it possible to pull out the buffer pad C from the box B by the weight, and the pad confirmation unit 33 has a proximity switch or the like that detects that the suction unit 31 is at a descent position. According to this configuration, the box B held by the robot 10 upside down is fitted to the pad taking-out apparatus 30. If the buffer pad C is not present, the suction unit 31 suctions the bottom portion of the box B, and the suction unit 31 is lifted up together with the box B when the robot 10 lifts up the box B. Therefore, when the pad confirmation unit 33 detects movement of the suction unit 31, it can be judged that the buffer pad C is not present. Further, in the present embodiment, the pad taking-out apparatus 30 is also used to hold the box B when the robot 10 cuts the tape that holds the lower outer flaps P4 sealing the bottom of the box B.

It is favorable that the folding-aid member 40 is a bar-shaped body that is substantially horizontally supported in a cantilevered state. Though the folding-aid member 40 is supported by a support 41 in the present embodiment, it may be held by a building or any other structure. The folding-aid member 40 can be formed of a pipe or a bar material. It is favorable that the diameter of the folding-aid member 40 is as small as possible within a range that rigidity can be secured so as to be insertable into the box B in various directions. Further, it is favorable that the length of the folding-aid member 40 is equal or higher than the height of the box sheet S in a folded state (a total of the height of the length face panels P1 and the extension lengths of the upper and lower outer flaps P3 and P4) so as to be able to support the box sheet S from inside as indicated by imaginary lines in FIG. 1. Further, it is favorable that the folding-aid member 40 is held at a position higher than a total length of one length face panel P1 and one width face panel P2 so as to be able to support the box sheet S preventing the box sheet S from coming into contact with the floor surface.

Figure 2:
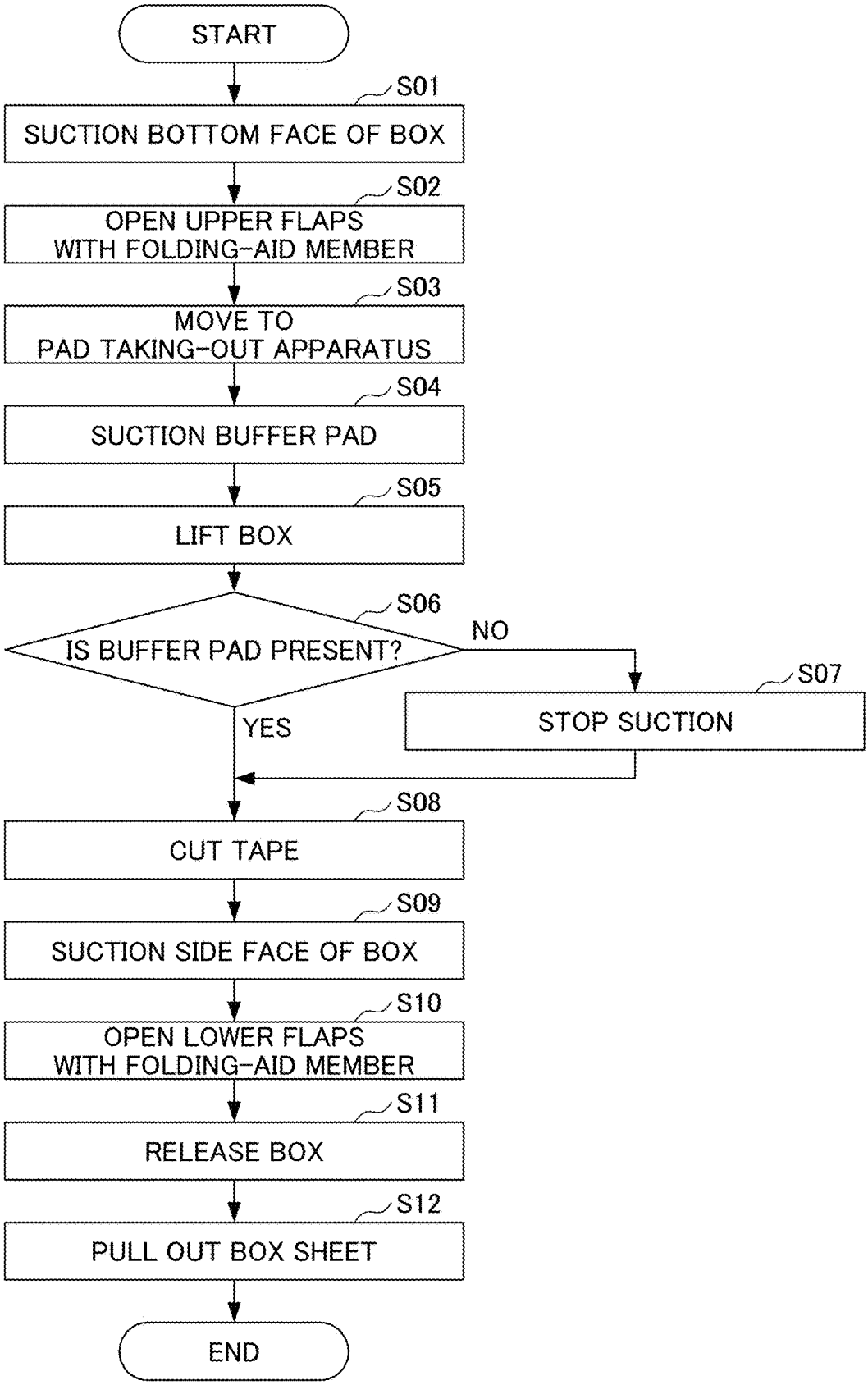
FIG. 2 is a flowchart showing a box folding procedure by the box folding system of FIG. 1.

The controller 50 can be configured, for example, with one or more computer apparatuses each of which has a memory, a processor, an input/output interface, and the like and executes an appropriate control program. Further, a part of the controller 50 may be configured with a physical circuit. The controller 50 controls the robot 10 and the pad taking-out apparatus 30 so that a process for folding the box B shown in FIG. 2 can be performed by the box folding system 1.

The process for folding the box B includes: a process for suctioning the bottom face of the box B by the work head 11 (S01: a bottom face suction process), a process for causing the box B to move so as to open the upper flaps P3 and P5 with the opening-aid member 20 (S02: an upper flaps opening process), a process for arranging the box B on the pad taking-out apparatus 30 (S03: a pad taking-out apparatus arrangement process), a process for suctioning the buffer pad C with the suction unit 31 of the pad taking-out apparatus 30 (S04: a buffer pad suction process), a process for lifting up the box B by the robot 10 (S05: a box lifting process), a process for judging presence or absence of the buffer pad C (S06: a buffer pad presence or absence judgment process), a process for stopping suction by the suction unit 31 when the buffer pad C is not present (S07: a suction stopping process), a process for cutting the tape that holds the lower outer flaps P4 of the box B, by the robot 10 (S08: a tape cutting process), a process for suctioning one of the upper outer flaps P3 of the box B and an adjoining length face panel P1 from the side face side of the box B with the work head 11 (S09: a side face suction process), a process for causing the box B to move so as to open the lower inner flaps P6 with the folding-aid member 40 (S10: a lower flaps opening process), a process for causing the folding-aid member 40 to support the box sheet S in the folded state by releasing the box B from the work head 11 (S11: a box releasing process), and a process for pulling out the box sheet S from the folding-aid member 40 by suctioning the length face panel P1 and a width face panel P2 with the work head 11 (S12: a box sheet pulling-out process).

In the bottom face suction process of S01, the bottom face of the box B which is sealed with the tape is suctioned with the work head 11. The bottom face of the box B may be suctioned after suctioning a side face of the box B with the work head 11 once and then laying down the box B on its side.

In the upper flaps opening process of S02, the upper flaps P3 and P5 are sequentially caused to come into contact with the opening-aid member 20 and turn to the outer side one by one, by causing the box B to move by the robot 10. Thereby, each of the upper flaps P3 and P5 is caused to have such a tendency of being folded that it is held in a state of being open to the outside. That is, the robot 10 inserts the opening-aid member 20 among the upper flaps P3 and P5, causes the opening-aid member 20 to come into contact with any of the upper flaps P3 and P5, and causes the box B to move to a position where the quadrilateral-tube-shaped portion of the box B does not overlap the opening-aid member 20 in plan view. Furthermore, it is favorable that the robot 10 causes the upper flaps P3 and P5 to rotate to the outside a lot, by causing the box B to move downward.

In the pad taking-out apparatus arrangement process of S03, the box B is fitted to the pad taking-out apparatus 30 by the robot 10. Thereby, the suction unit 31 of the pad taking-out apparatus 30 is into a state of supporting the bottom (the lower flaps P4 and P6) of the box B from inside via the buffer pad C.

In the buffer pad suction process of S04, the buffer pad C present inside the box B is suctioned by starting vacuum suction by the suction unit 31. When the buffer pad C is not present, the suction unit 31 suctions the bottom of the box B.

In the box lifting process of S05, the box B is lifted up a little by the robot 10. When the buffer pad C is present inside the box B, the suction unit 31 stays as it is by its own weight together with the suctioned buffer pad C and causes the buffer pad C to be separated from the bottom of the box B, by the robot 10 lifting up the box B. On the other hand, when the buffer pad C is not present inside the box B, the robot 10 lifts up the suction unit 31 suctioning the bottom of the box B, together with the box B.

In the buffer pad presence or absence judgment process of S06, it is decided whether or not to perform the suction stopping process of S07, based on a result of the detection of the suction unit 31 by the pad confirmation unit 33 in the box lifting process.

In the suction stopping process of S07, the inner face of the bottom of the box B is released from the suction unit 31 by stopping vacuum suction by the suction unit 31.

In the tape cutting process of S08, the box B is released from the work head 11, and the tape pasted on the bottom face of the box B with the cutter 13 of the work head 11 to make it possible to open the lower outer flaps P4 and the lower inner flaps P6.

In the side face suction process of S09, first, the work head 11 is arranged such that a part thereof is located above one of the lower outer flaps P4, and the remaining part protrudes to the outside of the box B. In this state, the lower outer flap P4 is suctioned with the work head 11, and the work head 11 is caused to move to draw a 90-degree arc so as to open the suctioned lower outer flap P4 by causing the lower outer flap P4 to swing around the proximal-end edge. Thereby, the remaining part of the work head 11 can suction a length face panel P1 adjoining the lower outer flap P4. As a result, the work head 11 suctions and holds the lower outer flap P4 and the length face panel P1 on the same virtual plane. By causing the work head 11 to move vertically in this state, it is possible to cause the box B to be removed from the pad taking-out apparatus 30, leaving the buffer pad C.

In the lower flaps opening process, by causing the box B to move, with the work head 11 being in a posture of suctioning the length face panel P1 and a connected outer flap P4 on the same plane, with the other length face panel P1 arranged on a lower side, each of the lower inner flaps P6 is caused to come into contact with the folding-aid member 40 and thereby opened.

Figure 3:
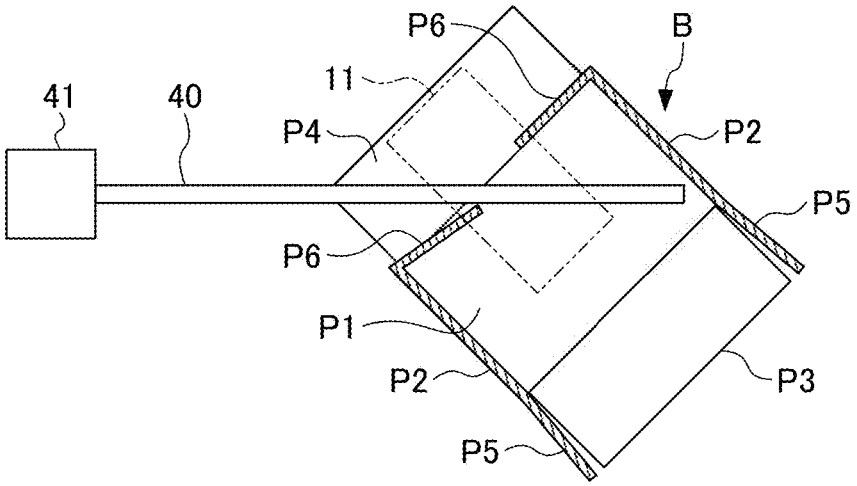
FIG. 3 is a schematic cross-sectional view illustrating one scene of a lower flap opening operation by the box folding system of FIG. 1.

Specifically, first, as shown in FIG. 3, by holding the box B such that the width face panels P2 are inclined relative to the folding-aid member 40 and causing the box B to move in the longitudinal direction of the folding-aid member 40, by the robot 10, the distal end portion of the folding-aid member 40 is inserted into the box B. At this time, one lower inner flap P6 that is located on the distal end side of the folding-aid member 40 should be prevented from being pushed into the inside of the box B. Therefore, another lower inner flap P6 that is located at the proximal end side of the folding-aid member 40 may be slightly pushed into the inside of the box B.

Figure 4:
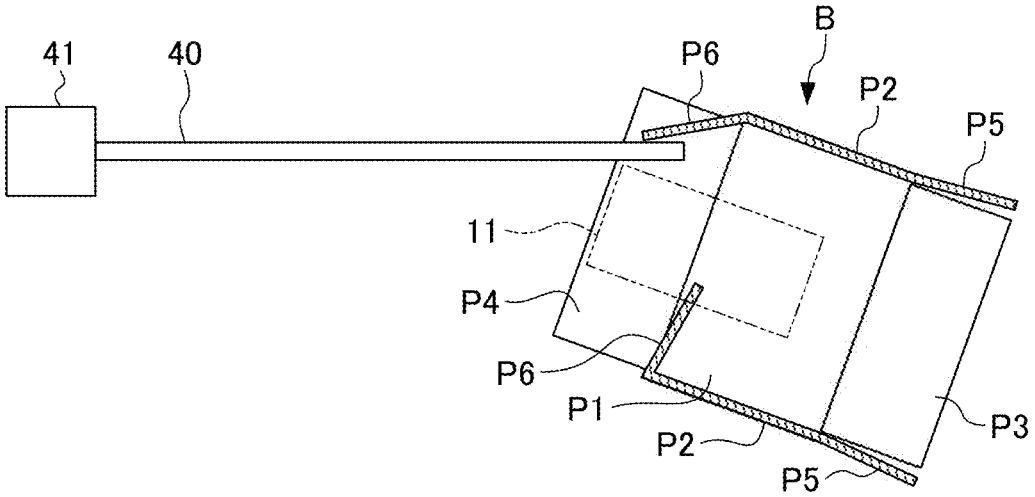
FIG. 4 is a schematic cross-sectional view illustrating the next scene following FIG. 3 of the lower flap opening operation by the box folding system of FIG. 1.
Figure 5:
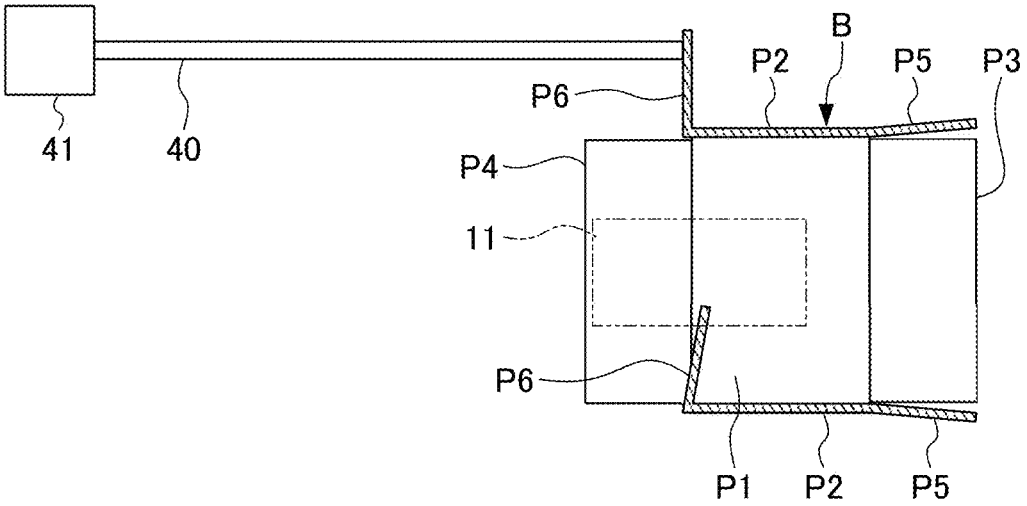
FIG. 5 is a schematic cross-sectional view illustrating the next scene following FIG. 4 of the lower flap opening operation by the box folding system of FIG. 1.

Then, as shown in FIG. 4, by pulling the box B in a direction along the width face panels P2 by the robot 10, the lower inner flap P6 located on the distal end side of the folding-aid member 40 can be opened. Furthermore, by causing the box B to move by the robot 10 on a locus that has a component of a direction along the lower edge of the length face panels P1, within a range that the lower inner flap P6 located at the distal end side of the folding-aid member 40 is not separated from the folding-aid member 40, the lower inner flap P6 is widely opened to the outer side of the box B to have a tendency of being folded in an open state as shown in FIG. 5.

Figure 6:
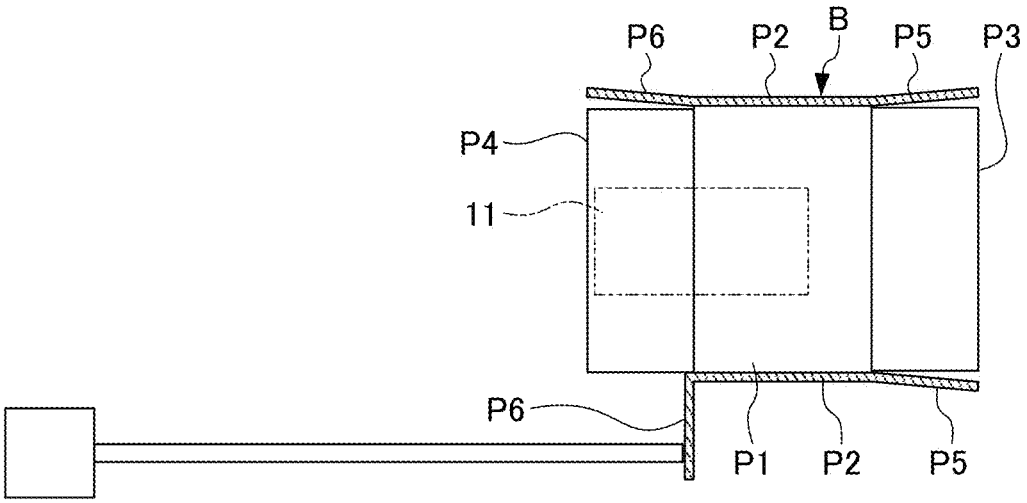
FIG. 6 is a schematic cross-sectional view illustrating the next scene following FIG. 5 of the lower flap opening operation by the box folding system of FIG. 1.

Furthermore, by similarly causing the box B to move by reversing the inclination and the movement trajectory of the box B relative to the folding-aid member 40, by the robot 10, the lower inner flap P6 on the opposite side can also have the tendency of being folded in an open state as shown in FIG. 6. Thereby, all the flaps P3 to P6 are arranged on the outside of the quadrilateral tube shape portion, and the box B is in a state of easily being folded such that the width face panels P2 are overlapped on the respective length face panels P1.

The lower outer flap P4 that is not suctioned with the work head 11 can be opened by its own weight. When the tendency of the lower outer flap P4 being folded is strong, however, the box B may be caused to move so as to cause the lower outer flap P4 that is not suctioned with the work head 11 to come into contact with the folding-aid member 40 to be opened, before opening the lower inner flaps P6.

In the box releasing process of S11, the box is released from the work head 11 so as to cause the folding-aid member 40 to support the box sheet S at a boundary between the length face panel P1 and a width face panel P2. That is, by leaving the box B to the folding-aid member 40, the box B is folded by its own weight, and the folded box sheet S is hung from the folding-aid member 40.

In the box sheet pulling-out process of S12, the box sheet S is pulled out from the folding-aid member 40 by the robot 10, while one of the length face panels P1 of the box sheet S and an adjoining width face panel P2, which are supported by the folding-aid member 40, being held with the work head 11 on substantially the same plane. The box sheet S hanging from the folding-aid member 40 can be in an incompletely folded state with a slight inner space being left, due to the thickness of the folding-aid member 40. If it is difficult to hold the length face panel P1 and the width face panel P2 on the same plane in this state, the length face panel P1 and the width face panel P2 may be into a state of being suctioned on the same plane, by tilting the work head 11 to be adjusted to whichever is located on the upper side between the length face panel P1 and the width face panel P2 first, holding only the length face panel P1 or the width face panel P2 that is on the upper side, pulling out the box sheet S from the folding-aid member 40 in the horizontal direction or arranging the folding-aid member 40 in the central part of the box sheet S in the vertical direction by lifting up the box sheet S in the vertical direction, and then turning the work head 11 so that the suction surface becomes vertical.

In the state of the length face panel P1 and the width face panel P2 being suctioned with the work head 11 on the same plane, the box sheet S can be held in a substantially folded state even if the work head 11 is turned so that the suction surface is vertical. Therefore, it is also possible to sequentially stack box sheets S folded by the robot 10 on a predetermined place.

As described above, since the box folding system 1 causes the box B to move by the robot 10 and opens the lower inner flaps P6 by causing them to come into contact with the folding-aid member 40, the tolerance to size differences among boxes B is large, and, even in the case of folding boxes B that are significantly different in size, a range that can be responded to only by changing an operation program for the robot 10 is large.

An embodiment of the present disclosure has been described above. The present invention, however, is not limited to the embodiment described above. Further, the effects described in the embodiment described above are merely enumerated as favorable effects obtained by the present invention, and effects of the present invention are not limited to those described in the embodiment described above.

As an example, the box folding system according to the present disclosure may be applied to a box the bottom (the lower flaps) of which is open at the time of taking out a commodity, and the upper flaps may be opened by the folding-aid member. Further, in the box folding system according to the present disclosure, both of upper flaps and lower flaps may be opened by the folding-aid member. Therefore, in the box folding system according to the present disclosure, the opening-aid member can be omitted. Further, in the box folding system according to the present disclosure, the pad taking-out apparatus also is not an indispensable component, and cutting of a tape may be performed at a place other than the pad taking-out apparatus. Further, in the box folding system according to the present disclosure, the work head may not have the tape cutter, and cutting of a tape may be performed by a tape cutting mechanism such as a robot, which is separately provided. Further, the box folding system according to the present disclosure may be configured such that a robot different from the robot that opens flaps and causes the folding-aid member to hold a box sheet pulls out the box sheet from the folding-aid member. Furthermore, in the box folding system according to the present disclosure, other work, for example, taking-out of a commodity packaged in a box or assistance for the taking-out work may performed by the robot.

EXPLANATION OF REFERENCE NUMERALS

1 BOX FOLDING SYSTEM
10 ROBOT
11 WORK HEAD
12 SUCTION PAD
13 CUTTER
14 SENSOR
20 OPENING-AID MEMBER
21 TABLE
30 PAD TAKING-OUT APPARATUS
31 SUCTION UNIT
32 SUPPORT UNIT
33 PAD CONFIRMATION UNIT
40 FOLDING-AID MEMBER
41 SUPPORT
50 CONTROLLER
B BOX
C BUFFER PAD
P1 LENGTH FACE PANEL
P2 WIDTH FACE PANEL
P3 UPPER OUTER FLAP
P4 LOWER OUTER FLAP
P5 UPPER INNER FLAP
P6 LOWER INNER FLAP
S BOX SHEET

The invention claimed is:

1. A box folding system for folding a box formed of a box sheet including a plurality of interconnected panels, the box folding system comprising:

a robot that has a work head which suctions the box sheet, and that moves the box; and a folding-aid member that changes relative angles of the panels by coming into contact with the box moved by the robot, wherein the plurality of panels include a pair of length face panels and a pair of width face panels, which are laterally and alternately connected to form a quadrilateral-tube-shaped portion, two pairs of outer flaps extending from upper edges and lower edges of the pair of length face panels, respectively, and two pairs of inner flaps extending from upper edges and lower edges of the pair of width face panels, respectively; and the robot moves the box so as to open each of the inner flaps by the folding-aid member, with the work head being in a posture of suctioning one of the length face panels and one of the outer flaps that is connected thereto, on a same plane, with the other length face panel arranged on a lower side, and then releases the box from the work head so as to cause the folding-aid member to support the box sheet at a boundary between the length face panel and one of the width face panels.

2. The box folding system according to claim 1, wherein the folding-aid member is a bar-shaped body substantially horizontally supported in a cantilevered state.

3. The box folding system according to claim 1, wherein the robot holds, with the work head, one of the length face panels and adjoining one of the width face panels that are on one face side of the box sheet supported by the folding-aid member, on a substantially same plane.

4. The box folding system according to claim 1, further comprising a pad taking-out apparatus that has a suction unit which is inserted into the box and which suctions a buffer pad arranged in the box.

5. The box folding system according to claim 4, wherein the pad taking-out apparatus has:

a support unit supporting the suction unit such that the suction unit is movable in a direction of insertion into the box; and a pad confirmation unit detecting movement of the suction unit relative to the support unit.

6. A box folding system for folding a box formed of a box sheet including a plurality of interconnected panels, the box folding system comprising:

a robot that has a work head which suctions the box sheet, and that moves the box;

a folding-aid member that changes relative angles of the panels by coming into contact with the box moved by the robot; and a pad taking-out apparatus that has a suction unit which is inserted into the box and which suctions a buffer pad arranged in the box.

* * * * *